US007364246B2

(12) United States Patent
Okamoto

(10) Patent No.: US 7,364,246 B2
(45) Date of Patent: Apr. 29, 2008

(54) LIQUID SUPPLYING METHOD

(75) Inventor: Hideaki Okamoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 409 days.

(21) Appl. No.: 11/158,139

(22) Filed: Jun. 21, 2005

(65) Prior Publication Data

US 2005/0285886 A1 Dec. 29, 2005

(30) Foreign Application Priority Data

Jun. 24, 2004 (JP) ..... 2004-186308
Jun. 7, 2005 (JP) ..... 2005-167407

(51) Int. Cl.
*B41J 2/195* (2006.01)

(52) U.S. Cl. ..... 347/7

(58) Field of Classification Search ..... 347/7, 347/19, 85, 86, 87; 141/2, 18
See application file for complete search history.

(56) References Cited

U.S. PATENT DOCUMENTS 5,280,300 A 1/1994 Fong
6,447,084 B1 * 9/2002 Uetsuki et al. ..... 347/7
6,739,712 B2 * 5/2004 Kim ..... 347/87

FOREIGN PATENT DOCUMENTS

JP 8-323996 A 12/1996

* cited by examiner

*Primary Examiner*—Anh T. N. Vo
(74) *Attorney, Agent, or Firm*—Canon USA Inc I.P. Div

(57) ABSTRACT

A liquid-supplying method includes the steps of controlling a magnitude of negative pressure generated by a negative-pressure generating member provided in each of first liquid-tank components included in a first liquid tank such that the magnitude of the negative pressure generated during a liquid-supply operation is greater than that in a state other than the liquid-supply operation, detecting an amount of liquid consumption in each first liquid-tank component, determining an amount of liquid to be supplied to each first liquid-tank component based on the detection result, and controlling the magnitude of the negative pressure generated by the negative-pressure generating member with respect to each first liquid-tank component based on the determined amount of liquid to be supplied to the first liquid-tank component.

13 Claims, 12 Drawing Sheets

LIQUID SUPPLYING METHOD

BACKGROUND OF THE INVENTION

1. Field of the Invention

The present invention relates to a liquid supplying method for supplying ink used for image formation on a recording medium or for supplying processing liquid used for adjusting the printing quality of ink to be discharged onto a printing medium.

2. Description of the Related Art

An example of a typical inkjet printer that forms an image by discharging ink is a serial-scanning type. An inkjet printer of this type is provided with a cartridge that includes an ink-discharging print head and an ink tank that are detachably combined with each other. Such a cartridge is disposed on a carriage. By driving the carriage in a main scanning direction and feeding printing paper in a sub scanning direction, the inkjet printer performs a printing operation in a serial-scanning manner.

In an inkjet printer of a serial-scanning type, every time the ink in the ink tank becomes empty, the ink tank must be replaced with a new one. If the volume of the ink tank were to be increased in order to reduce the replacement frequency, the carriage becomes larger in size. This is problematic in view of louder noise and larger vibration during the printing operation.

Japanese Patent Laid-Open No. 8-323996 (corresponding to U.S. Pat. No. 5,280,300), for example, discloses a structure for preventing such problems. In detail, a relatively small sub tank is provided on a carriage, and a larger-sized main tank is also provided such that the main tank is connected to the sub tank via a tube and a valve. When the ink in the sub tank decreases and the negative pressure in the sub tank thus increases, the valve is opened so that the sub tank communicates with the main tank. The difference in pressure between the sub tank and the main tank allows the ink contained in the main tank to be supplied to the sub tank.

According to Japanese Patent Laid-Open No. 8-323996, however, the sub tank and the main tank must be positioned vertically with respect to each other, and therefore, an overall size reduction of a printer is difficult. Moreover, a driving source for an ink-supply operation is defined by a negative-pressure generating mechanism provided inside the sub tank, and a driving force that can be generated by the negative-pressure generating mechanism is limited to an extent that discharge nozzles can be maintained in a proper condition. As a result, the ink-supply operation takes a large amount of time. On the other hand, as a type of method for supplying the sub tank with ink contained in the main tank, an intermittent ink-supplying method, which will be referred to as a pit-stop ink-supplying method hereinafter, is known. In the pit-stop ink-supplying method, the main tank and the sub tank are disconnected with each other during a printing operation, and are connected to each other when the sub tank needs to be supplied with ink. If such method type is applied to the structure disclosed in Japanese Patent Laid-Open No. 8-323996, the printing operation has to pause for a long period of time if the ink-supply operation takes a large amount of time. Furthermore, if the printer is tilted at an angle, there may be cases where, for example, the ink cannot be supplied to the sub tank depending on the angle, or the ink may leak through the nozzles due to oversupplying of ink.

SUMMARY OF THE INVENTION

The present invention is directed to a liquid-supplying method of a pit-stop supplying type in which a negative-pressure generating member is applied so that a liquid-supply operation can be smoothly and properly performed.

According to one aspect of the present invention, a liquid-supplying method is provided. In the liquid-supplying method, liquid is supplied to each of first liquid-tank components included in a first liquid tank from a corresponding one of second liquid-tank components included in a second liquid tank by using negative pressure generated by a negative-pressure generating member provided in each first liquid-tank component, the first liquid tank being movable together with a liquid discharge unit during a printing operation, each first liquid-tank component storing the liquid to be discharged during the printing operation, each second liquid-tank component storing the liquid to be supplied to the corresponding first liquid-tank component. The method includes the step of controlling a magnitude of negative pressure generated by the negative-pressure generating member in each first liquid-tank component such that the magnitude of the negative pressure generated during a liquid-supply operation is greater than that in a state other than the liquid-supply operation. Accordingly, the difference in pressure between each first liquid-tank component and the corresponding second liquid-tank component can be made large when the liquid-supply operation is to be performed.

Furthermore, the method includes the step of detecting an amount of liquid consumption in each first liquid-tank component, determining an amount of liquid to be supplied to each first liquid-tank component based on the amount of liquid consumption detected in the detecting step, and controlling the magnitude of the negative pressure generated by the negative-pressure generating member with respect to each first liquid-tank component based on the determined amount of liquid to be supplied to the first liquid-tank component.

In one embodiment, the method includes the step of detecting an orientation of one of the first liquid tank, the second liquid tank, and a printing device provided with the first liquid tank and the second liquid tank and determining whether the orientation detected is within a predetermined range. In this case, the liquid may be supplied to the first liquid tank from the second liquid tank when the detection result is within the predetermined range. Accordingly, the liquid-supply operation can be performed in a state where the difference in pressure between each first liquid-tank component and the corresponding second liquid-tank component is at a suitable value.

In one embodiment, the method includes setting the amount of negative pressure generated by the negative-pressure generating member when the liquid is supplied to each first liquid-tank component from the corresponding second liquid-tank component within a range such that liquid in discharge nozzles provided in the liquid discharge unit is prevented from flowing in a direction opposite to a discharging direction of the liquid discharge unit. Accordingly, this can achieve a state where the liquid is always ready to be discharged.

In one embodiment, the control step includes individually controlling any increase in the magnitude of the negative pressure generated by the negative-pressure generating member for each of the first liquid-tank components depending on the amount of liquid to be supplied to each of the first liquid-tank components.

In one embodiment, the negative-pressure generating member is formed of a shape-memory material. The controlling step includes applying electricity to the negative-pressure generating member with respect to each first liquid-tank component when the liquid-supply operation is to be performed. Accordingly, this can increase an elastic coefficient of the negative-pressure generating member, whereby the negative pressure can accordingly be increased.

Furthermore, an amount of electricity applied to the negative-pressure generating member with respect to each first liquid-tank component may be controlled depending on the amount of liquid to be supplied to the first liquid-tank component. Accordingly, the magnitude of the negative pressure with respect to each first liquid-tank component can be controlled based on the amount of liquid consumption in the first liquid-tank component.

Since the magnitude of negative pressure generated in each first liquid-tank component is controlled such that the magnitude of the negative pressure generated during a liquid-supply operation is greater than that in a state other than the liquid-supply operation, the difference in pressure between each first liquid-tank component and the corresponding second liquid-tank component can be made large when the liquid-supply operation is to be performed. Accordingly, the time required for the liquid-supply operation can be shortened.

Furthermore, since the magnitude of the negative pressure generated by the negative-pressure generating member with respect to each first liquid-tank component may be controlled based on a determined amount of liquid to be supplied to the first liquid-tank component, the liquid-supply operation can be performed according to the amount of liquid consumption in the first liquid-tank component. Moreover, since the liquid may be supplied to the first liquid tank from the second liquid tank when the detected orientation is within a predetermined range, the liquid-supply operation can be performed in a state where the difference in pressure between each first liquid-tank component and the corresponding second liquid-tank component is at a suitable value. Accordingly, this can prevent problems such as leaking of the liquid through the discharge nozzles and an inability to supply the liquid to each first liquid-tank component. Furthermore, as described above, the negative pressure generated by the negative-pressure generating member when the liquid-supply operation is performed may be set within a range such that the liquid in the discharge nozzles provided in the liquid discharge unit is prevented from flowing in a direction opposite to the discharging direction of the liquid discharge unit, thereby achieving a state where the liquid is always ready to be discharged. Accordingly, a recovery process for the discharge nozzles is not necessary, and a waste of liquid is thus prevented. Moreover, as described above, when the liquid is to be supplied to each of the first liquid-tank components, the magnitude of the negative pressure generated by the negative-pressure generating member does not necessarily need to be increased for every first liquid-tank component. Accordingly, the liquid-supply operation can be performed according to the amount of liquid consumption in each first liquid-tank component. Furthermore, since electricity may be applied to the negative-pressure generating member with respect to each first liquid-tank component when the liquid-supply operation is to be performed, and the negative-pressure generating member may be formed of a shape-memory material, the elastic coefficient of the negative-pressure generating member can be increased, whereby the negative pressure can accordingly be increased. Moreover, since the amount of electricity applied to the negative-pressure generating member with respect to each first liquid-tank component may be controlled depending on the amount of liquid to be supplied to the first liquid-tank component, the magnitude of the negative pressure with respect to each first liquid-tank component can be controlled based on the amount of liquid consumption in the first liquid-tank component. Accordingly, the liquid-supply operation can be performed according to the amount of liquid consumption in each first liquid-tank component, thus contributing to lower power consumption.

Further features and advantages of the present invention will become apparent from the following description of exemplary embodiments (with reference to the attached drawings).

DESCRIPTION OF THE EMBODIMENTS

First Embodiment

An image formation device according to a first embodiment of the present invention is directed to a printer of a pit-stop ink-supplying type in which an ink-supply path extending between a main tank and a sub tank is connected only when an ink-supply operation is performed.

Figure 1:
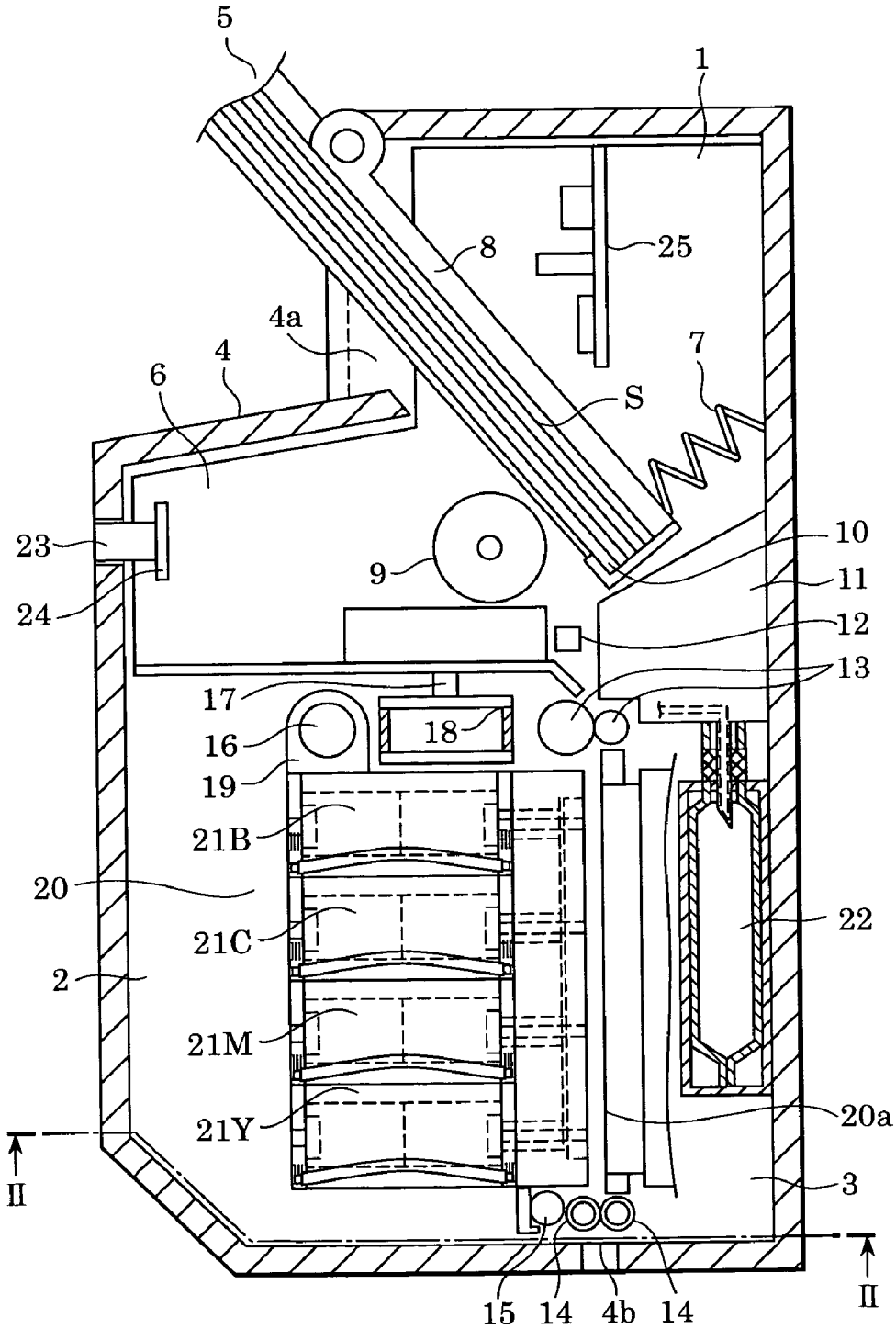
FIG. 1 is a cross-sectional view of a serial-type inkjet printer defining an image formation device according to a first embodiment of the present invention.
Figure 2:
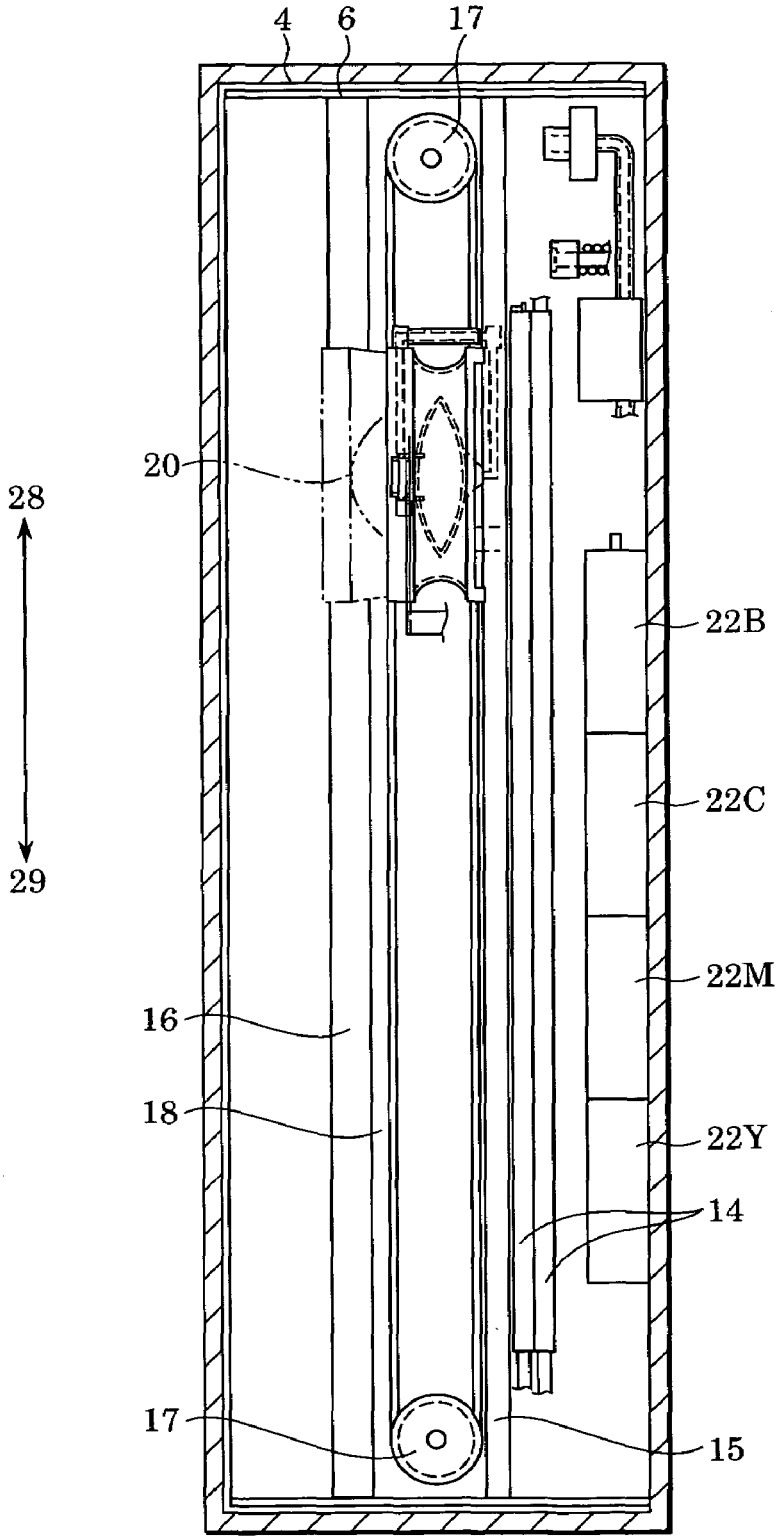
FIG. 2 is a cross-sectional view taken along line II-II in FIG. 1.

FIGS. 1 and 2 are cross-sectional views of an inkjet printer defining an image formation device according to the first embodiment of the present invention. An image formation device according to the first embodiment is a serial-scanning type in which a liquid discharge head is movable in a main scanning direction. Referring to FIG. 1, a printer body mainly includes, for example, a medium-feeding element 1 for feeding printing media S; a printing element 2 that performs a printing operation; and an ink-refilling element 3 that performs an ink-refilling operation.

Reference numeral 4 indicates a cover disposed on the exterior of the printer body, and reference numeral 5 indicates a tray on which multiple sheets of printing media S can be stacked. Each sheet of printing medium S is inserted into an insertion hole 4*a* provided in the cover 4 and is ejected from an exit hole 4*b*. A pair of side plates 6 is provided in the interior of the cover 4. The side plates 6 contain therein a loading tray component 8, a feeding roller 9, and a guide member 11. The loading tray component 8 defines a loading mechanism for loading the printing media S, and is biased upward towards the feeding roller 9 by a spring 7. The feeding roller 9 defines a medium-feeding mechanism and is in contact with an uppermost sheet of printing medium S of the plurality of printing media S disposed on the loading tray component 8. The single uppermost sheet of printing medium S is set apart from the multiple sheets of printing media S via a separating unit 10 and is guided by the guide member 11 towards the printing element 2.

Reference numeral 12 indicates a photo-sensor for detecting the printing medium S passing through a downstream side of the guide member 11. Reference numeral 13 indicates a pair of conveying rollers for conveying the printing medium S at a constant rate. Reference numeral 14 indicates another pair of conveying rollers for ejecting the printing medium S having an image printed thereon. Reference numeral 19 indicates a carriage which is capable of moving in the main scanning direction indicated by arrows 28, 29 shown in FIG. 2 while being guided by guide members 15 and 16. The main scanning direction corresponds to a width direction of the printing medium S. The carriage 19 receives a driving force transmitted from a carriage motor (not shown) via a belt 18 extending between a pair of pulleys 17 so as to be moved in the main scanning direction. Reference numeral 20 indicates a liquid storage tank, i.e. a sub tank, which is disposed on the carriage 19 in a replaceable manner. Reference numeral 20*a* indicates an inkjet head defining a liquid discharge head according to the present invention. The inkjet head will be referred to as a print head 20*a* hereinafter. The print head 20*a* discharges ink supplied from the sub tank 20.

In the first embodiment, the sub tank 20 and the print head 20*a* constitute an integrally-combined head cartridge. Alternatively, the sub tank 20 and the print head 20*a* may be separate components such that the two are detachably joined to each other. Furthermore, the two components may be separately attached to the carriage 19.

Referring to FIG. 1, reference numeral 24 indicates an electrical-wire substrate disposed in the interior of the cover 4. The electrical-wire substrate 24 is provided with a plurality of operating buttons 23 that extend through the cover 4 so as to be projected from the surface of the cover 4. Reference numeral 25 indicates a control unit, which includes an electrical-wire substrate used for a control operation and disposed in the interior of the cover 4. A microcomputer and a memory, for example, are disposed on this electrical-wire substrate. The control unit 25 controls the printer while communicating with a host computer.

Referring to FIG. 2, a main tank 22 according to the first embodiment is separated into tank components for storing different-color inks. Specifically, the main tank 22 includes a main-tank component 22Y for storing yellow ink, a main-tank component 22M for storing magenta ink, a main-tank component 22C for storing cyan ink, and a main-tank component 22B for storing black ink. The main-tank components 22Y, 22M, 22C, and 22B are respectively connected with supplying joints for the corresponding color inks via corresponding pipes (not shown). This will be described below in detail. The sub tank 20 in FIG. 2 is set at a position where a printing operation is being performed on the printing medium S, which is not shown in FIG. 2.

Figure 3:
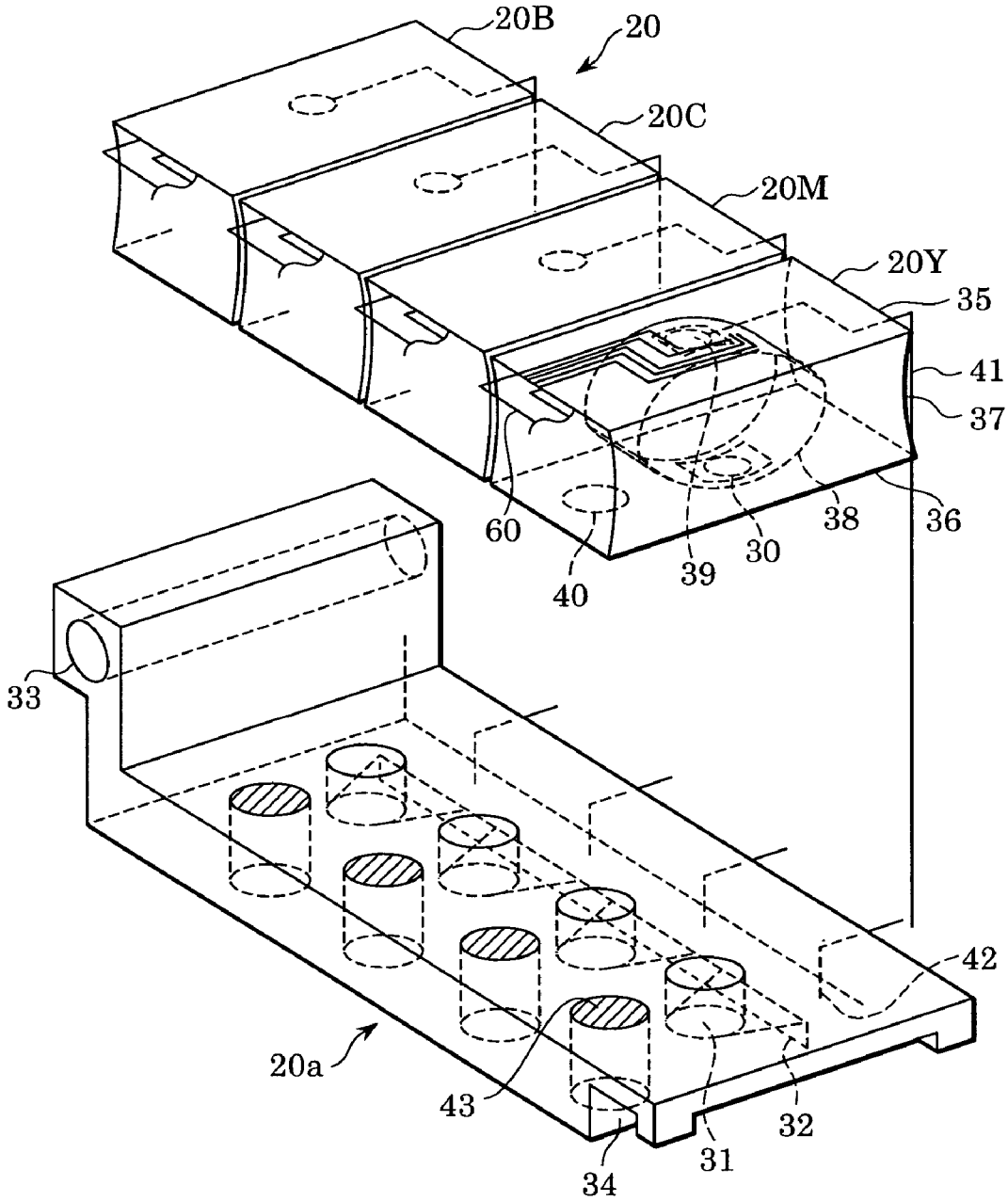
FIG. 3 is an exploded perspective view of a sub tank and a print head according to the first embodiment shown in FIG. 1.

FIG. 3 is an exploded perspective view of the head cartridge according to the first embodiment. The description below will mainly be directed to a sub-tank component 20Y included in the sub tank 20, and the descriptions for sub-tank components 20M, 20C, and 20B for the remaining three colors will be omitted since the four sub-tank components have the same structure. The sub-tank components 20Y, 20M, 20C, and 20B respectively correspond to the main-tank components 22Y, 22M, 22C, and 22B. The print head 20*a* includes a plurality of independent head portions for the corresponding colors. Each head portion is provided with a common ink chamber 31 that communicates with an ink-supply hole 30 provided in the corresponding sub-tank component of the sub tank 20, and a plurality of discharge nozzles 32 through which ink droplets are discharged. An ink channel that connects the common ink chamber 31 with the discharge nozzles 32 is provided with a discharging-energy generator (not shown) for generating energy used for discharging ink droplets through the discharge nozzles 32. Reference numeral 43 indicates a sealing member composed of rubber. Each sealing member 43 seals an ink-entrance hole 40 provided in the corresponding sub-tank component except for when ink is being supplied to the sub-tank component. Reference numerals 33 and 34 indicate bearing portions respectively for the guide members 16 and 15 shown in FIGS. 1 and 2.

Each sub-tank component of the sub tank 20 (which will mainly be directed to the sub-tank component 20Y hereinafter) is provided with a resin top plate 35, a resin bottom plate 36, an ink bag 37 disposed between the top plate 35 and the bottom plate 36, and a leaf spring 38 disposed inside the ink bag 37. The leaf spring 38 is formed of a titanium-nickel alloy having shape-memory properties and has a perforated structure as shown in the drawing. The leaf spring 38 has curved portions that are elastically deformable. When electricity is applied to the leaf spring 38, resistance heat is generated and thus fluctuates an elastic coefficient of the leaf spring 38, whereby an elastic force of the leaf spring 38 changes. Such a characteristic is utilized in order to control the elastic force of the leaf spring 38.

Any type of shape-memory material may be used for the leaf spring 38 as long as the material has flexibility at normal temperature and can be made rigid. As an alternative to a titanium-nickel alloy, a high-polymer-containing material such as a Cu-base alloy, namely, for example, a Cu—Zn—Al alloy or a Cu—Au—Ni alloy, may be used. Furthermore, instead of electrical application, the elastic force may alternatively be controlled by heating the shape-memory material using a heater.

An electrical-wire section of the leaf spring 38 is not shown in the drawings. The top plate 35 is provided with an exhaust valve 39, and the bottom plate 36 is provided with the ink-entrance hole 40. Moreover, a flexible exhaust tube 41 connects the top plate 35 with the corresponding discharge nozzles 32. Specifically, the exhaust valve 39 is connected with the exhaust tube 41 via a duct (dotted line) provided in the top plate 35, and the exhaust tube 41 is connected with a corresponding exhaust hole 42 via a corresponding duct provided in the print head 20*a*. Each exhaust hole 42 is flush with the discharge nozzles 32 and is provided for the corresponding color. When gas accumulates inside the sub-tank component 20Y, the exhaust valve 39 is opened and a capping member 47 (see FIGS. 7 to 9) is made in contact with the exhaust hole 42. Subsequently, a suction pump is driven so that the gas can be removed. Alternatively, the ducts in the print head 20*a* extending to the corresponding exhaust holes 42 may be combined into one such that only a single exhaust hole 42 is provided in the print head 20*a*. The top plate 35 of the sub-tank component 20Y has an electrode disposed thereon which extends inward of the sub-tank component 20Y, such that the electrode is used for ink detection. The electrode will be described below in detail. Reference numeral 60 indicates a flexible cable used for controlling the exhaust valve 39, the leaf spring 38, and a signal line extending from the electrode.

Figure 4:
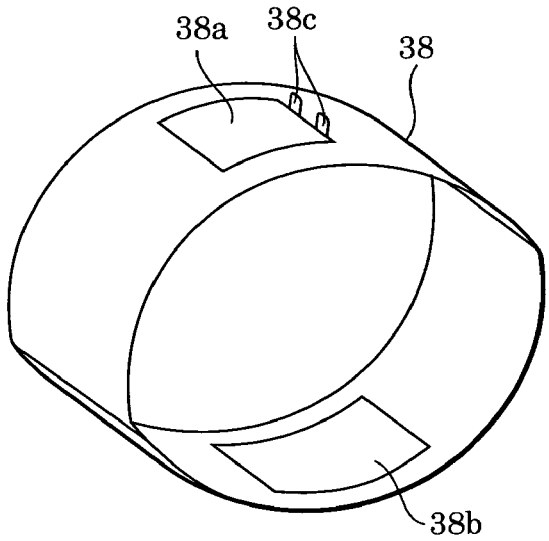
FIG. 4 is a perspective view of a leaf spring disposed in each sub-tank component of the sub tank.

FIG. 4 is a perspective view of the leaf spring 38. The leaf spring 38 is provided with openings 38*a*, 38*b* at positions corresponding to the exhaust valve 39 and the ink-supply hole 30, respectively. The leaf spring 38 is further provided with connection segments 38*c* which are formed by bending peripheral segments of the opening 38*a* by 90°. The connection segments 38*c* are to be connected to an electrical-wire. The electrical wire and the connection segments 38*c* are connected to each other via, for example, a sealant, an adhesive, and/or rubber packing in order to prevent the ink from leaking outward.

Figure 5:
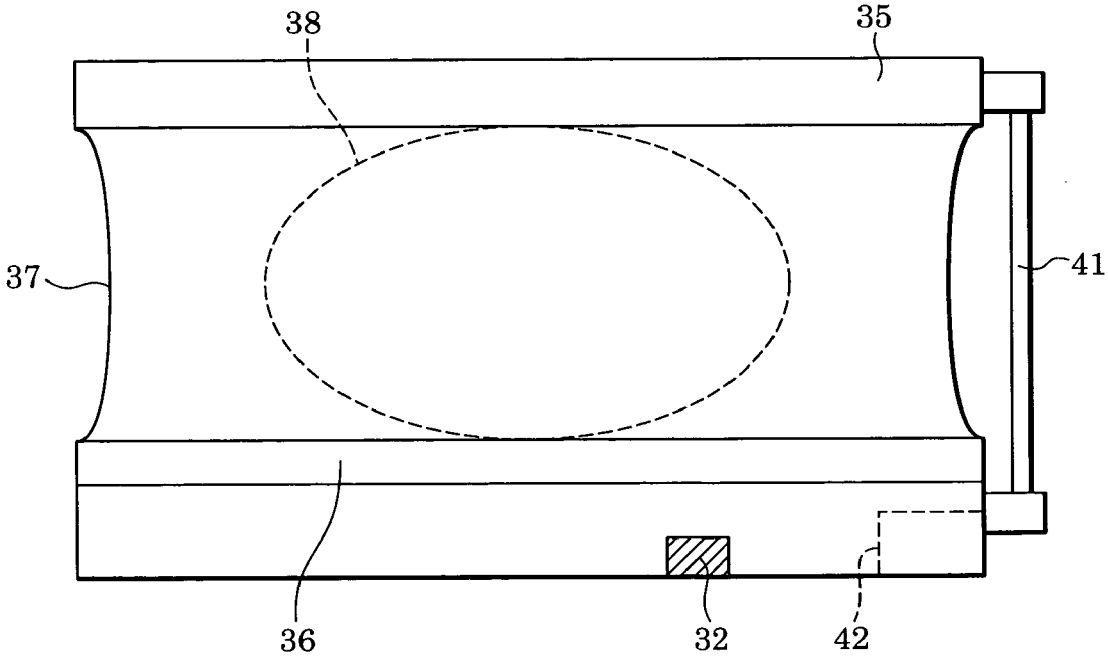
FIG. 5 is a front view of one of the sub-tank components.
Figure 6:
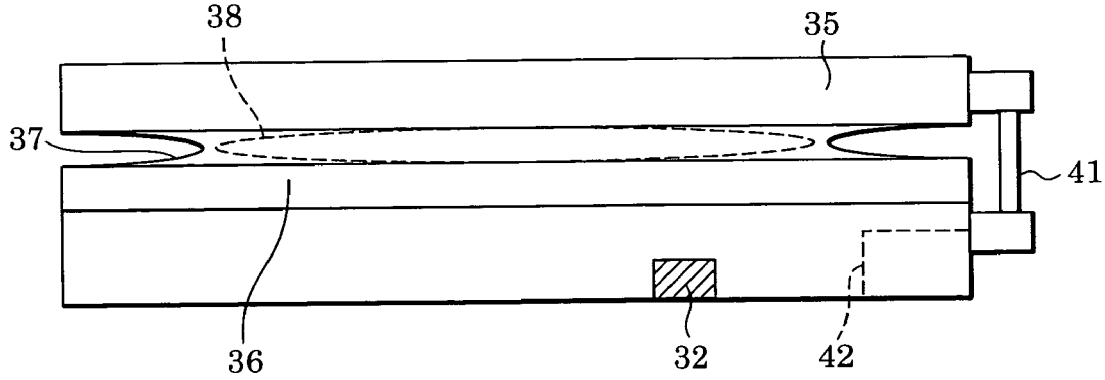
FIG. 6 is another front view of the sub-tank component.

FIGS. 5 and 6 are front views of one of the sub-tank components of the sub tank 20, in this case, the sub-tank component 20Y.

FIG. 5 illustrates a state where the sub-tank component 20Y is filled with ink. The leaf spring 38 is biased in opposite directions so as to widen the space between the top plate 35 and the bottom plate 36. Such a biasing force prevents the ink from leaking from the discharge nozzles 32, and moreover, generates a negative pressure that is necessary for the printing operation. The ink bag 37 defining side surfaces of the sub-tank component 20Y may be formed of, for example, one of the following materials: a laminate film containing an aluminum film layer and a resin film layer; a laminate film containing a plurality of resin film layers; a film material whose surface is provided with a coating that prohibits gas penetration; and a thin rubber material. When the ink is discharged from the discharge nozzles 32 and the ink contained in the sub-tank component 20Y thus decreases, the top plate 35 moves against the biasing force of the leaf spring 38 so as to descend towards the bottom plate 36. Consequently, the ink bag 37 folds and the height of the sub-tank component 20Y thus decreases. FIG. 6 illustrates a state where the ink inside the sub-tank component 20Y is completely empty. Due to having flexibility, the exhaust tube 41 in this state is deformed to form a U-shape in a direction perpendicular to the drawing of FIG. 6.

Figure 7:
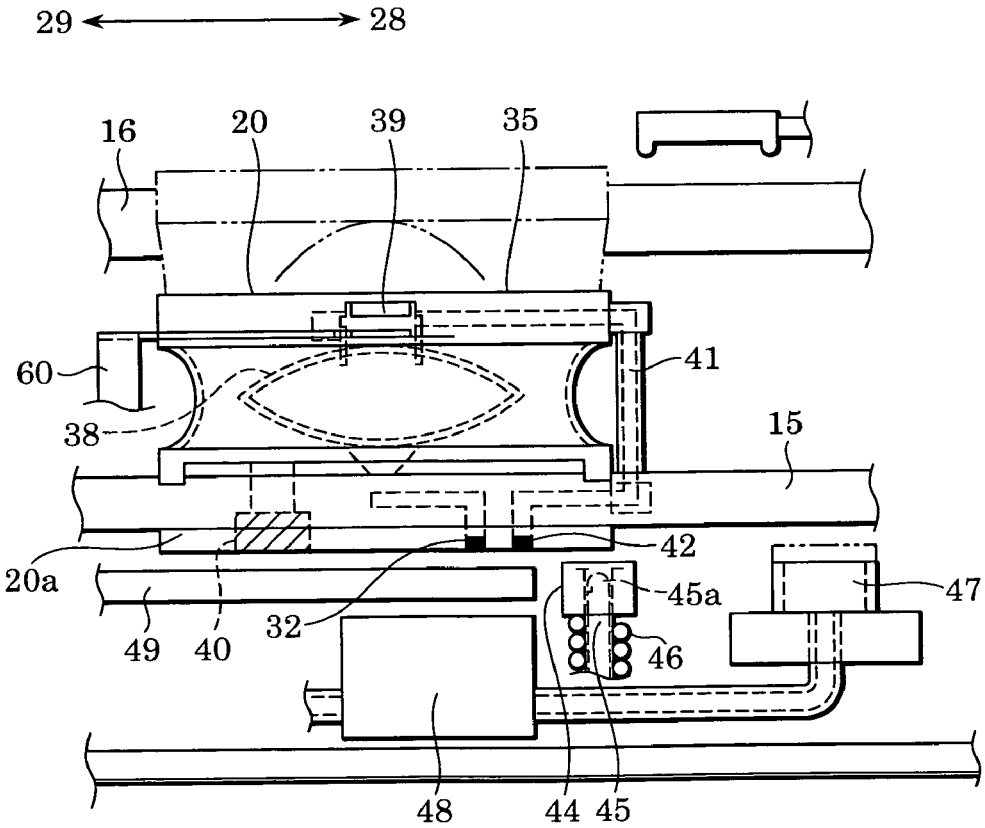
FIG. 7 illustrates a printing state.
Figure 8:
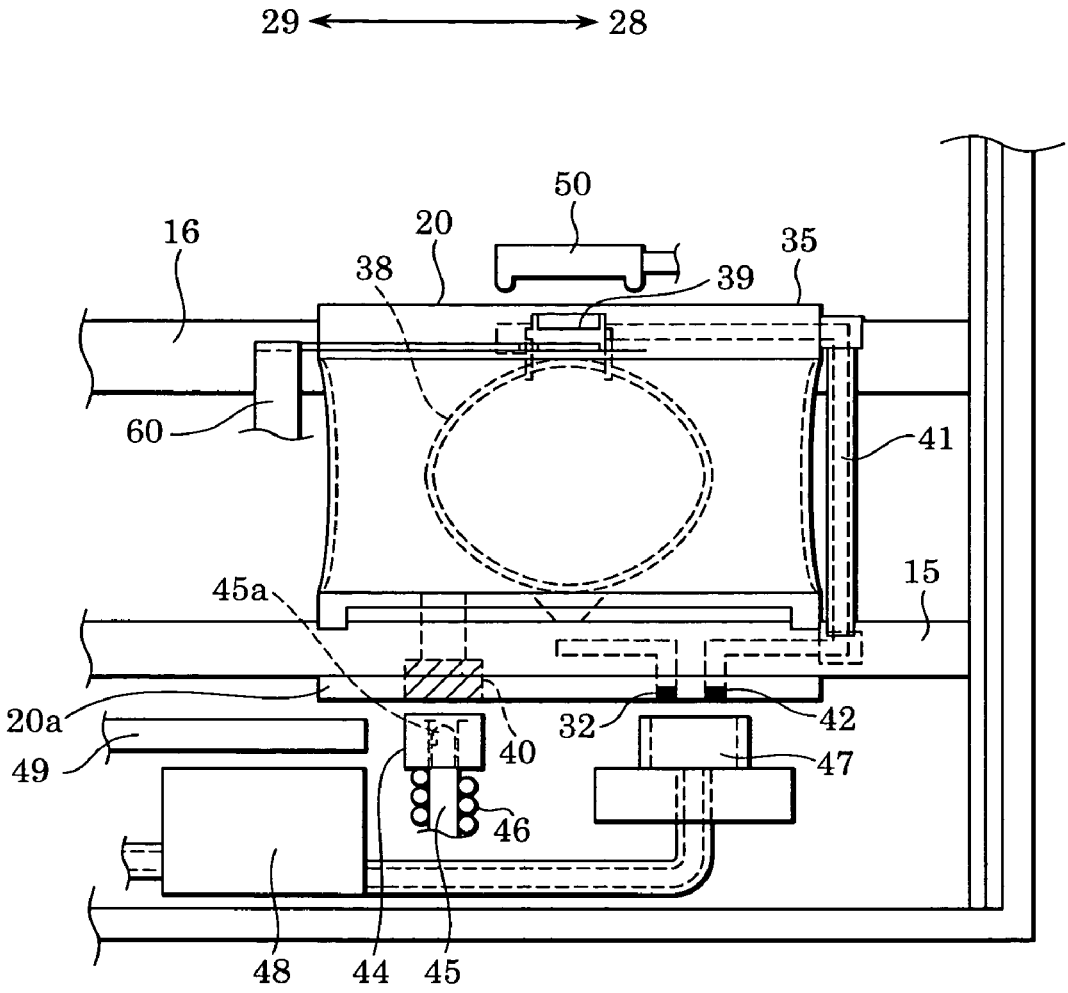
FIG. 8 illustrates a state where the sub tank and the print head are in a stand-by state or a power-off state.
Figure 9:
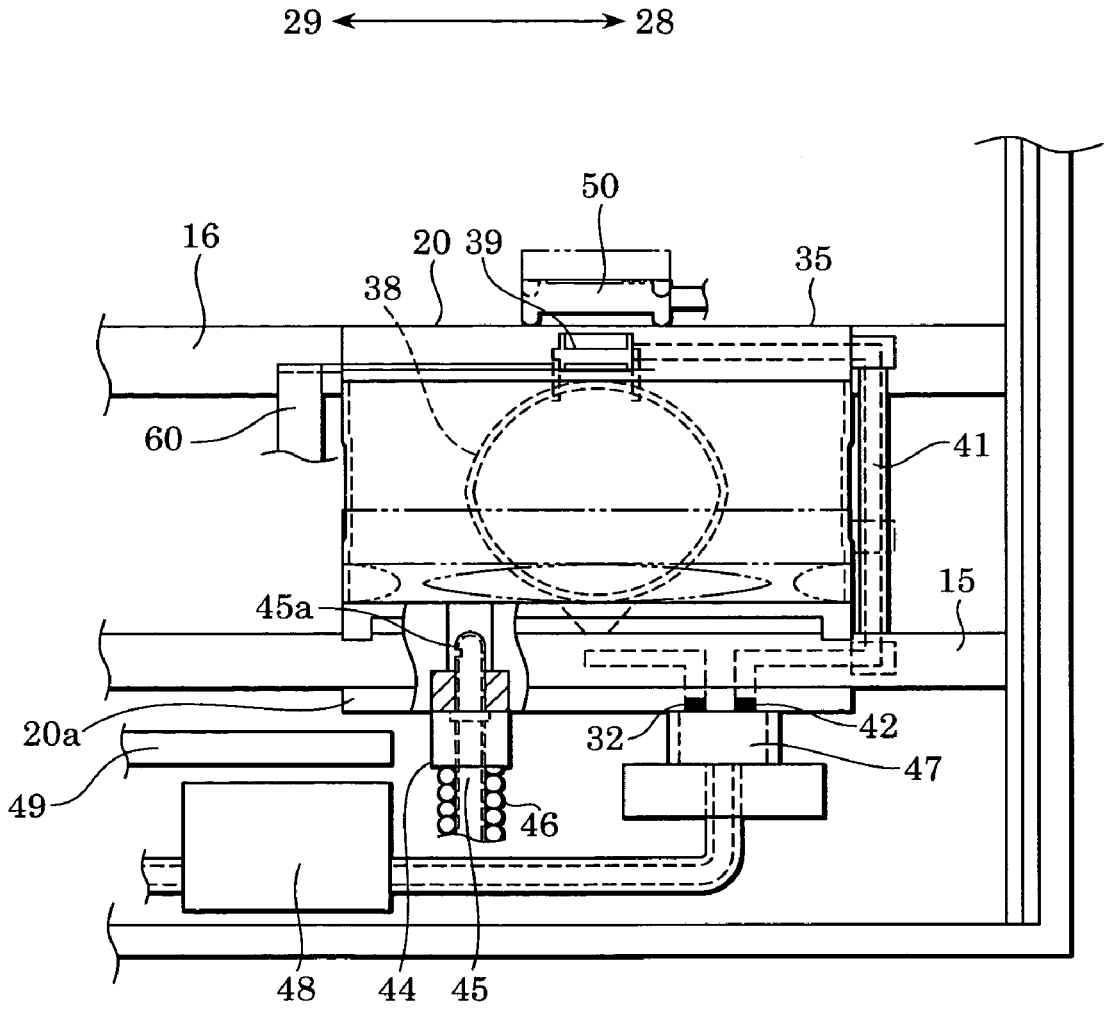
FIG. 9 illustrates a state where ink is being supplied from a main tank to the sub tank.

Referring to FIGS. 7 to 9, an actual operation performed in the inkjet printer will now be described. Each supplying joint connectable with the ink-entrance hole 40 of the corresponding sub-tank component of the sub tank 20, i.e. the sub-tank component 20Y, includes a sealing member 44, a supply tube 45, a spring 46, and a driving unit (not shown). One end of the supplying joint is connected to the corresponding one of the main-tank components 22Y, 22M, 22C, 22B (in this case, the main-tank component 22Y) such that the supplying joint is capable of refilling the sub-tank component 20Y with ink contained in the main-tank component 22Y.

A side surface of the supply tube 45 near a front end thereof is provided with an ink-supply hole 45*a*. The sealing member 44 composed of rubber is biased upward by the spring 46. The ink-supply hole 45*a* is sealed except for when an ink-supply operation is being performed. The front end of the supply tube 45 is blocked, whereas the base end is linked with the main-tank component 22Y. Reference numeral 47 indicates the capping member mentioned previously, which is movable in the vertical direction. The capping member 47 is linked with a waste-ink absorber (not shown) via a suction pump 48. Reference numeral 49 indicates a platen used for guiding the printing medium S to an image-printing position of the print head 20*a*.

FIG. 7 illustrates a printing state, FIG. 8 illustrates a stand-by state or a power-off state, and FIG. 9 illustrates an ink-supplying state. The positions of the relevant components will be described below in detail.

FIG. 7 illustrates a state where a printing operation is being performed. Specifically, a dot-dash line indicates a state in which the sub-tank component 20Y is filled with ink, whereas a solid line indicates a lowered state of the top plate 35 due to the reduced ink in the sub-tank component 20Y in response to discharging of ink from the discharge nozzles 32. During the printing operation, the exhaust valve 39 remains in a closed state.

FIG. 8 illustrates a state where the print head 20*a* is shifted to its home position. Here, the capping member 47 moves upward so as to cap the discharge nozzles 32 of the print head 20*a*. In this case, the ink-supply hole 45*a* of the supply tube 45 remains sealed by the sealing member 44.

Basically, the internal space of the sub-tank component 20Y is mostly filled with ink, and therefore, the amount of gas inside sub-tank component 20Y is small. For this reason, it is not necessary to take into consideration the expansion and contraction effects caused by pressure fluctuation in the sub-tank component 20Y in response to a change in ambient temperature. However, if gas is present inside the sub-tank component 20Y, the inner volume of the sub-tank component 20Y may change in response to the expansion and contraction effects, but since such a change can be compensated for by a deformation of the ink bag 37 composed of a film or a rubber material, the exhaust valve 39 remains to be in a closed state. When a certain volume of gas accumulates in the sub-tank component 20Y, the exhaust valve 39 is opened and the capping member 47 is made in contact with the exhaust hole 42. Subsequently, the suction pump 48 is driven so that the gas can be removed.

When the print head 20*a* is at its home position, a head discharge recovery process, which will simply be referred to as a recovery process hereinafter, is performed on the print head 20*a* such that ink not used for a subsequent printing operation of an image is drained. This allows the ink-discharging function to be maintained in a good state. The recovery process may be performed by, for example, applying a negative pressure generated by the suction pump 48 into the capping member 47 so as to force the ink to be sucked out and drained from the discharge nozzles 32 of the print head 20*a*, or by forcing the ink in the discharge nozzles 32 to be discharged into the capping member 47. Although both the discharge nozzles 32 and the exhaust hole 42 are capped by the capping member 47 when the print head 20*a* is at its home position, the ink is prevented from being sucked out through the exhaust valve 39 during the recovery process since the exhaust valve 39 remains in a closed state.

FIG. 9 illustrates a state where ink is being supplied from the main-tank component 22Y of the main tank 22 to the corresponding sub-tank component 20Y of the sub tank 20. The ink-supply operation is performed at a point where any one of the four color inks contained in the sub-tank components of the sub tank 20 falls below a predetermined amount. Alternatively, the number of discharged dots may be counted for each color ink such that the ink-supply operation is performed when any one of the color inks reaches a predetermined number of dots. As a further alternative, a photo-detector may additionally be provided such that the ink-supply operation is performed when the photo-detector detects that the top plate 35 of one of the sub-tank components descends to a predetermined position. A dot-dash line in FIG. 9 indicates the state of one of the sub-tank components of the sub tank 20 (in this case, the sub-tank component 20Y) just before the ink-supply operation.

When the print head 20*a* is shifted to an ink-refilling position, the capping member 47 moves upward so as to cover the discharge nozzles 32 of the print head 20*a*. While the ink-supply hole 45*a* remains to be sealed by the sealing member 44, a lifting/lowering mechanism (not shown) lifts the supply tube 45, the sealing member 44, and the spring 46 upward. When the sealing member 44 comes into contact with the sealing member 43 to seal the ink-entrance hole 40 of the sub-tank component 20Y, the spring 46 becomes compressed and the sealing member 44 thus begins to descend relatively with respect to the supply tube 45. Consequently, the supply tube 45 penetrates through the sealing member 43, whereby the ink-supply hole 45*a* is opened and thus communicates with the interior of the sub-tank component 20Y. This forms an ink-supply path between the sub-tank component 20Y and the corresponding main-tank component 22Y. A stopper, which is not shown, is provided for preventing the sub-tank component 20Y from rotating around the guide member 16.

In the first embodiment, the ink-supply operation begins at a point where the ink-supply hole 45*a* is opened in the interior of the sub-tank component 20Y, as shown in FIG. 9. The driving source for the ink-supply operation is usually based on the leaf spring 38 composed of a shape-memory material that generates a predetermined amount of negative pressure in the sub-tank component 20Y. In contrast to the main-tank component 22Y whose internal pressure corresponds to the atmospheric pressure, the internal pressure of the sub-tank component 20Y is about −50 mmAq (when the sub-tank component 20Y is full) to −200 mmAq (when the sub-tank component 20Y is empty) although such a range may vary depending on the discharging ability of the print head 20*a* and the specification of the leaf spring 38. When electricity is applied to the leaf spring 38, resistance heat is generated and thus increases a vertical elastic coefficient of the leaf spring 38 (Young's modulus E) by two to three times. In other words, the negative pressure in the sub-tank component 20Y is increased by two to three times so that the force biasing the top plate 35 upward is accordingly increased. When the ink-supply path is formed between the main-tank component 22Y and the sub-tank component 20Y, ink is supplied to the sub-tank component 20Y due to the pressure difference between the two tank components. This means that a greater difference in pressure between the two tank components, namely, a greater difference in negative pressure between the two, allows the ink to be supplied in a smaller amount of time. If the vertical elastic coefficient of the leaf spring 38 is increased by two to three times, the negative pressure in the sub-tank component 20Y is accordingly increased by two to three times, meaning that the time required for supplying ink to the sub-tank component 20Y is reduced by ⅓ to ½ of the time required using a leaf spring that is formed of a metallic material, such as stainless steel. Accordingly, during the printing state, the stand-by state, and the power-off state, the leaf spring 38 functions as a source for generating negative pressure to a degree that the printing quality is prevented from being adversely affected and that the ink is prevented from leaking. On the other hand, when ink is being supplied to the sub-tank component 20Y, the leaf spring 38 functions as a driving source for supplying the ink to the sub-tank component 20Y at high speed. Since the leaf spring 38 is formed of a shape-memory material, an appropriate force can be generated based on the conditions.

For example, if the elastic coefficient of the leaf spring 38 in an electrified state is set twice as large, and if electricity is applied to the leaf spring 38 when the negative pressure in the sub-tank component 20Y is −200 mmAq, the internal pressure of the sub-tank component 20Y becomes −400 mmAq. Since the pressure in the main-tank component 22Y is equal to the atmospheric pressure, the ink flows in a state where the pressure difference is 400 mmAq. The time required for supplying the ink can be determined according to Hagen-Poiseuille's law based on, for example, this pressure difference, the diameter of the ink-supply path between the main-tank component 22Y and the sub-tank component 20Y, the length of the path, and the viscosity of the ink. Actually, the amount of ink to be supplied and the amount of time for the ink-supply operation are first determined in order to determine the positional relationship between each main-tank component of the main tank 22 and the corresponding sub-tank component of the sub tank 20, the diameter of the ink-supply path, the length of the ink-supply path, and the strength of the leaf spring 38. The strength (elastic coefficient) of the leaf spring 38 is determined in view of the range of magnitude of the negative pressure such that the generated negative pressure prevents the ink in the discharge nozzles 32 from flowing in a direction opposite to the discharging direction during the ink-supply operation.

Referring to FIG. 9, when ink is supplied to the sub-tank component 20Y, the ink bag 37 restores its original shape and the top plate 35 is lifted upward. A stopper 50 is disposed above the top plate 35, such that the top plate 35 is stopped when it reaches this stopper 50. The stopper 50 is usually disposed at a position indicated by a dot-dash line shown in FIG. 9, and is not to be in contact with the top plate 35 except for when the ink-supply operation is being performed. During the ink-supply operation, the stopper 50 is moved downward by a lifting/lowering mechanism, which is not shown, to a position indicated by a solid line. The driving source for this lifting/lowering mechanism may be the same as that for the supply tube 45. When ink is supplied to the sub-tank component 20Y to a point where a detect unit (not shown) detects that the top plate 35 is in contact with the stopper 50, the electricity applied to the leaf spring 38 is turned off. When the top plate 35 of every sub-tank component reaches the corresponding stopper 50, the corresponding lifting/lowering mechanism (not shown) lowers the corresponding supply tube 45 so as to reach the state shown in FIG. 8. Thus, the ink-supply path between each main-tank component of the main tank 22 and the corresponding sub-tank component of the sub tank 20 becomes disconnected. In this case, if any of the top plates 35 does not reach the corresponding stopper 50 within a predetermined time period, or in other words, if there is a sub-tank component in which the electricity applied to the leaf spring 38 could not be turned off within that time period, the electricity applied to that leaf spring 38 is turned off after that time period. Thus, the corresponding supply tube 45 is lowered, and the ink-supply path between that sub-tank component and the corresponding main-tank component is disconnected. Such a predetermined time period is the maximum amount of time required for performing the ink-supply operation (including the margin in some cases) determined in view of, for example, the orientation of the printer, which will be described below in detail, such that when a sufficient amount of ink remains in the corresponding main-tank component of the main tank 22, the ink-supply operation can always be performed within the predetermined time period.

The failure to turn off the electricity applied to the leaf spring 38 of a sub-tank component corresponding to a certain color ink may possibly be due to the reason that the corresponding main-tank component is completely empty. On the other hand, a failure to detect whether or not a main-tank component is installed in the printer may possibly be due to the reason that the main-tank component is actually not properly installed in the printer. In either cases, the printer may warn a user with an alarm, or a warning may be displayed on a monitor of a computer connected to the printer. When the user properly sets the main-tank component in the printer, the ink-supply operation is performed over again.

Although a typical inkjet printer is capable of performing a printing operation using multiple color inks, such as four color inks and six color inks, there are usually differences in ink consumption among these inks depending on the content to be printed. For example, if a monochrome document were to be printed in large numbers, the printer may consume a significant amount of black ink. On the other hand, if a color image, such as a photograph image, were to be printed, the printer may consume a large amount of color inks. Accordingly, the ink consumption for each color ink depends on the content to be printed. This means that the amount of ink supplied from the main tank 22 to the sub tank 20 varies among the colors. When performing the ink-supply operation, the leaf springs 38 of the corresponding color inks may individually be controlled. For example, when a large amount of black ink is consumed to an extent that new black ink needs to be supplied, but if a sufficient amount of ink is still left for the remaining colors, electricity may be applied only to the leaf spring 38 in the sub-tank component 20B corresponding to the black ink, whereas the electricity is not applied to the leaf springs 38 in the remaining sub-tank components 20Y, 20M, and 20C. In this case, since a negative pressure as the same level as that during the printing operation is generated in each of the sub-tank components 20Y, 20M, and 20C, the corresponding inks may alternatively be supplied to these sub-tank components from the corresponding main-tank components of the main tank 22. This is permissible as long as the ink-supply operation for each of the sub-tank components 20Y, 20M, and 20C is completed before the completion of the ink-supply operation for the sub-tank component 20B. In other words, the time required for the overall ink-supply operation should not take a large amount of time. In the first embodiment, since the negative pressure generated by each leaf spring 38 in an electrified state is twice as large as the leaf spring 38 in a non-electrified state, the time required for supplying a certain color ink, whose ink consumption is ½ or less than that of the most-consumed color ink, is equal to or less than the time required for supplying the most-consumed color ink even if the leaf spring 38 corresponding to the certain color ink is not electrified during the ink-supply operation thereof. This can be achieved by detecting the remaining amounts of the inks of all colors before the ink-supply operation, and then comparing the detection results. Accordingly, this is advantageous in view of lower power consumption.

In the first embodiment, although one leaf spring 38 is provided for each of the sub-tank components of the sub tank 20, the leaf spring 38 in each sub-tank component may alternatively include a plurality of separated leaf spring parts. In this case, since the magnitude of negative pressure generated varies depending on the number of leaf spring parts that are electrified, the magnitude of negative pressure in each sub-tank component can be controlled in a more precise manner in view of ink consumption. For example, if two leaf spring parts are provided in each sub-tank component, three ways of controlling the magnitude of negative pressure are possible depending on the ink consumption. Specifically, the three ways are electrifying both leaf spring parts, electrifying only one leaf spring part, and not electrifying the leaf spring parts at all.

On the other hand, when a single leaf spring 38 is provided in each sub-tank component of the sub tank 20, the magnitude of negative pressure may alternatively be controlled by adjusting the amount of electricity applied. Similar to the above, such a control is performed within a range that the overall ink-supply operation does not take a large amount of time. Since the generated force becomes larger as the amount of electricity applied is increased, a larger amount of electricity may be applied to a leaf spring 38 corresponding to a sub-tank component with greater ink consumption.

Accordingly, the leaf springs 38 in the corresponding sub-tank components can be individually controlled, whereby oversupplying of ink is prevented.

When the top plates 35 come into contact with the corresponding stoppers 50, the internal pressure of the sub tank 20 is substantially equal to the atmospheric pressure. When the stoppers 50 are lifted upward from this state so as to move away from the top plates 35, the forces generated by the corresponding leaf springs 38 move the top plates 35 slightly upward. This achieves a balanced positional state in which a predetermined negative pressure is generated. In this case, the exhaust valves 39 remain in a closed state.

It may be possible that the printer be left laying in high temperature, such as in a sun-heated vehicle. If such high temperature is equivalent to the temperature that changes the elastic coefficient of the leaf springs 38, the leaf springs 38 could reach a state equivalent to an electrified state even if the power of the printer is not turned on. Consequently, the negative pressure in the sub tank 20 increases. As mentioned above, since the elastic coefficient of the leaf springs 38 (i.e. the intensity of the leaf springs 38) is set such that the ink in the discharge nozzles 32 is prevented from flowing in the reverse direction, even if the temperature rises drastically, the printer can recover its discharging function as soon as the temperature decreases back to the normal temperature.

As mentioned above, if gas is present inside the sub tank 20, the inner volume of the sub tank 20 may change in response to expansion and contraction effects. However, since such a change can be compensated for by the deformation of the ink bags 37 composed of a film or a rubber material, the exhaust valves 39 remain in a closed state.

The orientation of the printer could possibly affect the ink-supply operation. For example, with respect to the orientation of the printer under normal use, the sub tank 20 and the main tank 22 are separated from each other by 300 mm in the horizontal direction, and each leaf spring 38 is set so as to generate a negative pressure of −50 to −200 mmAq in a non-electrified state, and −100 to −400 mmAq in an electrified state (twice as large as that in the non-electrified state). When one of the sub-tank components becomes empty and the negative pressure thereof is −150 mmAq in a state where the corresponding leaf spring 38 is in a non-electrified state, the negative pressure in the sub-tank component will reach −300 mmAq when electricity is applied to the leaf spring 38 to perform the ink-supply operation. In this case, if the printer is positionally set at 90° such that the sub tank 20 is disposed above the main tank 22, and if the sub-tank component and the corresponding main-tank component are connected to each other in this state, the negative pressure of −300 mmAq in the sub-tank component is cancelled due to the difference in the head levels between the sub-tank component and the main-tank component. This means that the ink cannot be supplied to the sub-tank component. Since the ink consumption is different for each color ink, if there is a sub-tank component whose negative pressure has not reached −300 mmAq (−150 mmAq in a non-electrified state), it may be possible that the ink contained in this sub-tank component may flow in the reverse direction towards the corresponding main-tank component. In contrast, if the printer is positionally set such that the main tank 22 is disposed above the sub tank 20, the pressure difference between the sub tank 20 and the main tank 22 becomes large, whereby the ink-supply operation can be performed at higher speed. This, however, may be problematic in some cases since the ink may be supplied to each sub-tank component of the sub tank 20 at once, thus leading to oversupplying of ink. In this case, even when the corresponding stopper 50 is shifted away from the top plate 35, the sub-tank component does not reach a negative-pressure state, meaning that the ink could possibly leak out from the discharge nozzles 32.

The sub tank 20 and the main tank 22 can be positioned closer to each other in the horizontal direction to prevent such problems, but due to various restrictions, a certain distance must be maintained between the two.

The printer is therefore provided with a detector for detecting the angle and the orientation of the printer. In detail, when the detected result exceeds a certain range, the main tank 22 and the sub tank 20 are not connected to each other even if any of the sub-tank components of the sub tank 20 needs to be supplied with ink. Based on the detection result of the detector, the printer may warn a user with an alarm, or a warning may be displayed on a monitor of a computer connected to the printer. In either case, the user may operate the printer or the monitor to cancel the warning so that the detector may start detecting the angle and the orientation of the printer again.

Furthermore, the orientation of the printer may be detected during the ink-supply operation so that when there is a drastic change in the orientation and the detected result thus exceeds the certain range, the electricity applied to each leaf spring 38 is turned off immediately. Subsequently, each supply tube 45 is lowered by the corresponding lifting/lowering mechanism (not shown) so as to reach the state shown in FIG. 8. Thus, the ink-supply path between each main-tank component of the main tank 22 and the corresponding sub-tank component of the sub tank 20 is disconnected.

The detection standard of the detector may, for example, be set such that the permissible range of the ink-supplying time is within ±N % on the basis of the ink-supplying time required with respect to the printer oriented under normal use. In detail, the main tank 22 and the sub tank 20 may be connected to each other if the ink-supplying time is within that range. The ink-supplying time is inversely proportional to the pressure difference between the sub tank 20 and the main tank 22. Consequently, if the negative pressure in one of the sub-tank components of the sub tank 20 during an ink-supply operation (during electrical application of the corresponding leaf spring 38) is indicated by −P (mmAq); and if the distance between the sub tank 20 and the main tank 22 in the same plane is indicated by L (mm); and if the orientation (angle) of the printer within the same plane is indicated by θ (when the sub tank 20 is disposed above the main tank 22, θ>0), the following formula stands.

$$P\div\{(100-N)/100\}>P+L\sin\theta>P\div\{(100+N)\}/100) \qquad \text{Formula 1:}$$

In this case, when P=400 mmAq; and when N=20% (the permissible range of the ink-supplying time is within ±20% with respect to the ink-supplying time under the normal orientation); and when L=200 mm, 30°>θ>−20°. If the orientation of the printer is within this range, the ink-supply operation may be performed.

The angle θ determined by the above formula may be applied to all directions, or alternatively, the angle θ may be determined for each direction in order to achieve further precision. The actual printer may possibly be tilted in various directions, and even at the same angle, the difference in the head levels between the sub tank 20 and the main tank 22 may vary depending on the tilted direction. For example, if the printer is tilted with respect to an imaginary line extending between the sub tank 20 and the main tank 22 such that the imaginary line acts as a tilting axis, the ink-supplying time is almost the same as when the printer is oriented under normal use since there is only a small difference in the vertical relationship (the difference in head levels) between the sub tank 20 and the main tank 22. In this case, the ink-supply operation for each sub-tank component of the sub tank 20 can be performed even if the angle θ is out of the permissible range. Accordingly, the control operation of the printer may be performed while taking into consideration the positional relationship between the sub tank 20 and the main tank 22.

Figure 14:
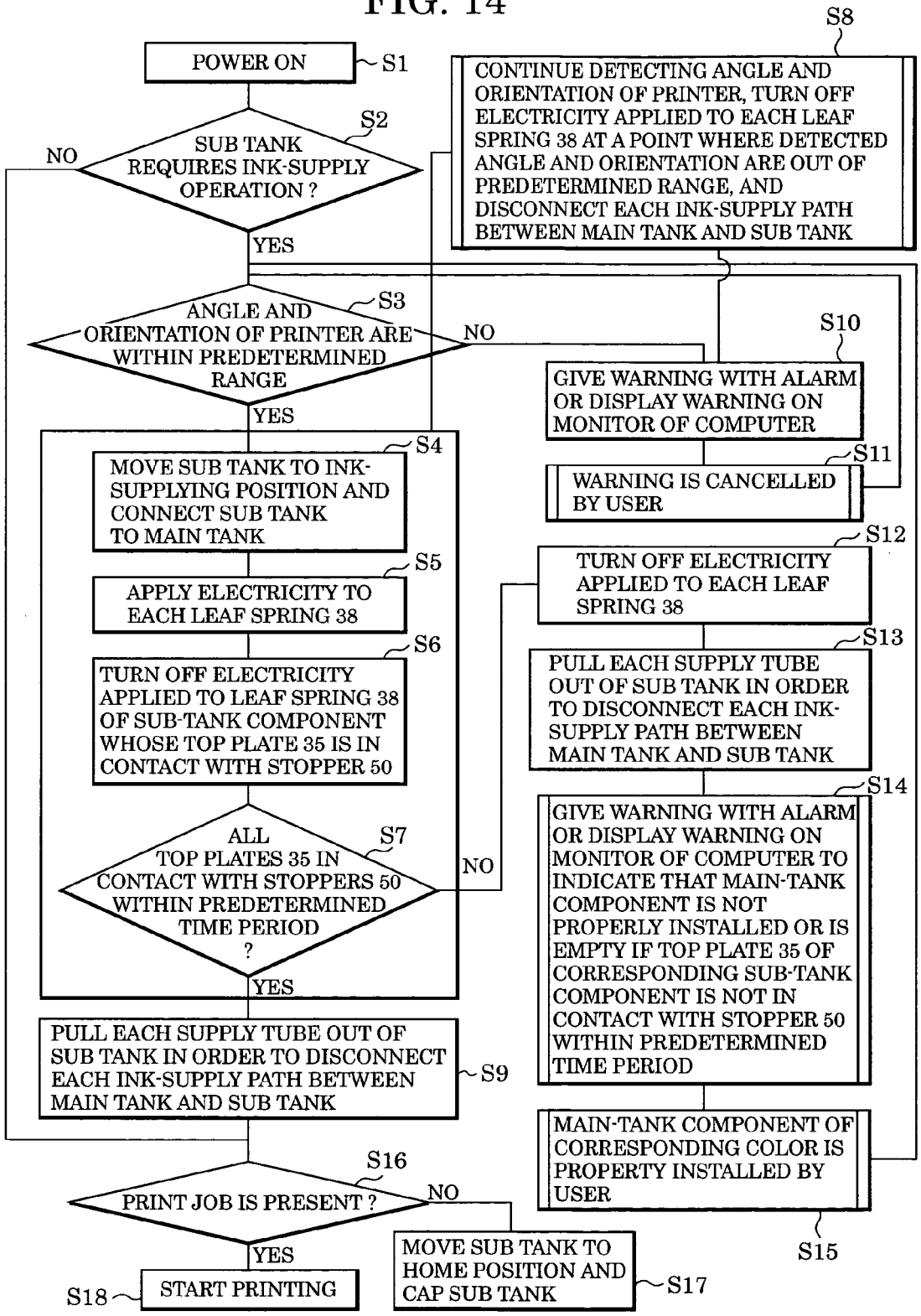
FIG. 14 is a flow chart illustrating an ink-supply operation.

FIG. 14 is a flow chart illustrating the process of supplying ink to the sub tank 20 from the main tank 22.

When the power of the printer is turned on in step S1, a detector detects whether or not the sub tank 20 needs to be supplied with ink in step S2. If the detection result in step S2 indicates that an ink-supply operation is not necessary, the operation proceeds to step S16 where it is determined whether or not a print job is present. If a print job is present, the operation proceeds to step S18 where a printing operation is started. On the other hand, if a print job is not present, the operation proceeds to step S17 where the carriage 19 is shifted to its home position and the print head 20*a* is capped so that the printer is switched to a stand-by mode.

On the other hand, if the detection result in step S2 indicates that an ink-supply operation for the sub tank 20 is necessary, it is determined in step S3 whether the ink can be safely supplied to the sub tank 20. In other words, it is determined whether the orientation of the printer is within a predetermined range. If the orientation of the printer is within the predetermined range, the carriage 19 is shifted so that the sub tank 20 is moved to the ink-refilling position in step S4, whereby the sub tank 20 and the main tank 22 are connected to each other. Subsequently, in step S5, electricity is applied to each leaf spring 38 in the corresponding sub-tank component of the sub tank 20 until the corresponding top plate 35 and the stopper 50 come into contact with each other. In step S6, although the time required for the electrical application is different for each sub-tank component depending on the amount of ink remaining in the sub-tank component, the electricity is turned off when the top plate 35 of the sub-tank component comes into contact with the corresponding stopper 50. In this case, it is determined in step S7 whether all top plates 35 are in contact with the corresponding stoppers 50 within a predetermined time period, and whether the electricity applied to each of the leaf springs 38 is turned off. If it is determined that the electricity applied to each leaf spring 38 is turned off, the sub tank 20 and the main tank 22 are disconnected in step S9 so that each ink-supply path is cut off. Subsequently, the operation proceeds to step S16 where it is determined whether or not a print job is present.

If it is determined in step S3 that the orientation of the printer is not appropriate for performing the ink-supply operation, the operation proceeds to step S10 where the printer warns a user with an alarm, or a warning is displayed on a monitor of a computer so as to notify the user. When the warning is cancelled by the user in step S11, the operation returns to step S3 where it is determined whether the orientation of the printer is appropriate for performing the ink-supply operation.

On the other hand, if it is not determined in step S7 that all top plates 35 are in contact with the corresponding stoppers 50, the electricity applied to each of the leaf springs 38 is temporarily turned off in step S12. Then, in step S13, the sub tank 20 and the main tank 22 are disconnected. In step S14, if any top plate 35 is not in contact with the corresponding stopper 50 within the predetermined time period, the printer notifies the user by giving a warning with an alarm or displaying a warning on a monitor of a computer so as to indicate that a main-tank component of the corresponding color is not properly installed in the printer or is empty and that the ink-supply operation cannot therefore be performed. In step S15, the main-tank component of the corresponding color is properly installed or is replaced with a new one by the user. When the proper installation or replacement of the main-tank component is detected, the operation returns to step S3.

Second Embodiment

In the first embodiment, each leaf spring 38 is formed of a bent shape-memory plate material and is disposed inside the corresponding sub-tank component of the sub tank 20. In the second embodiment, coil springs are used in place of the leaf springs 38, such that these coil springs are disposed on the exterior of the corresponding sub-tank components of the sub tank 20. This is advantageous especially in a case where the ink and the shape-memory material have a problem in view of compatibility.

Figure 10:
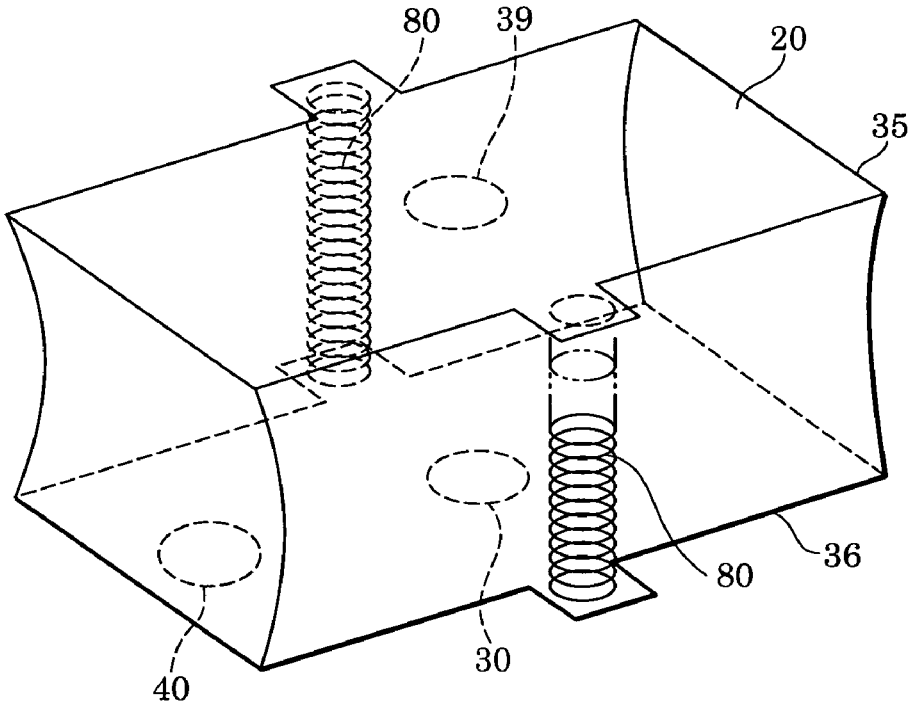
FIG. 10 is a perspective view of an example of one of sub-tank components of a sub tank according to a second embodiment of the present invention.
Figure 11:
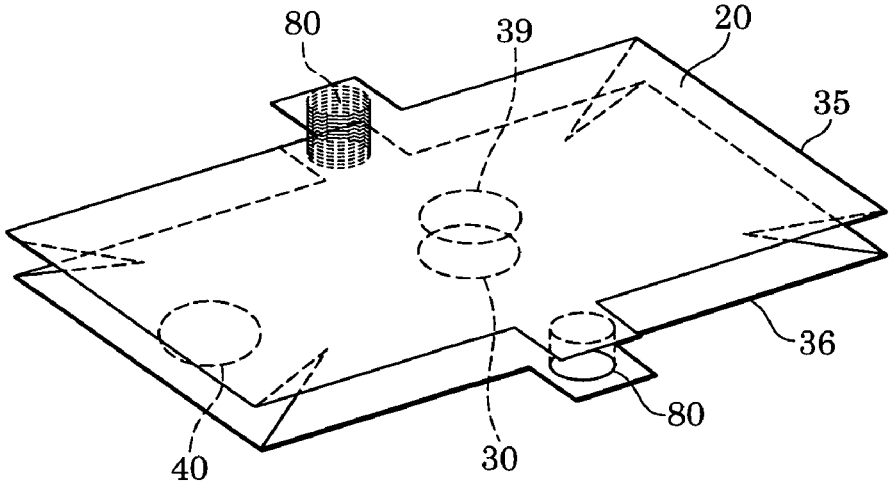
FIG. 11 is another perspective view of the sub-tank component according to the second embodiment of the present invention.
Figure 12:
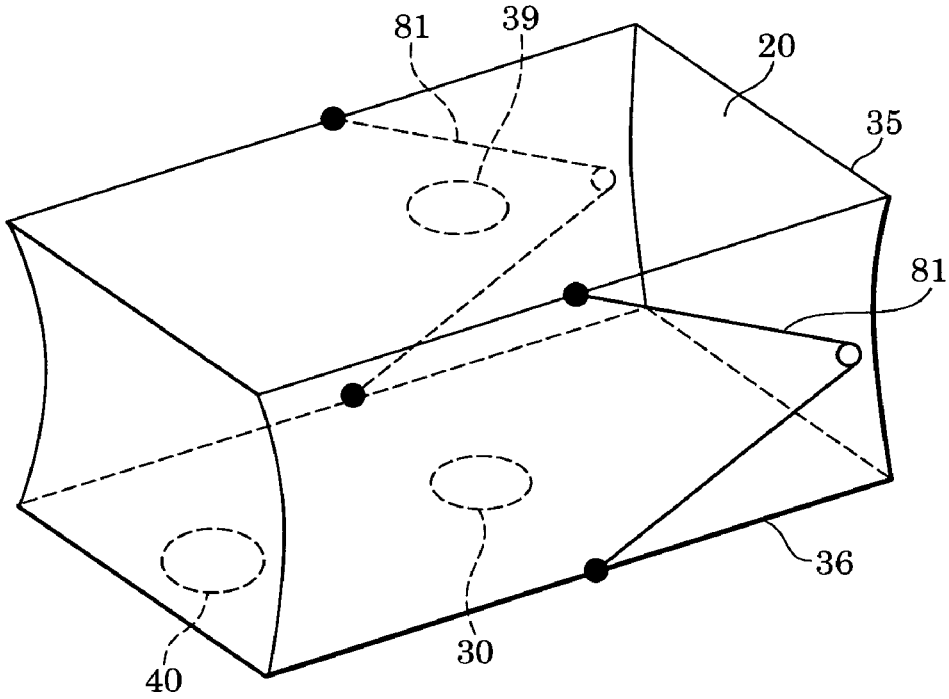
FIG. 12 is a perspective view of another example of one of sub-tank components of the sub tank according to the second embodiment of the present invention.
Figure 13:
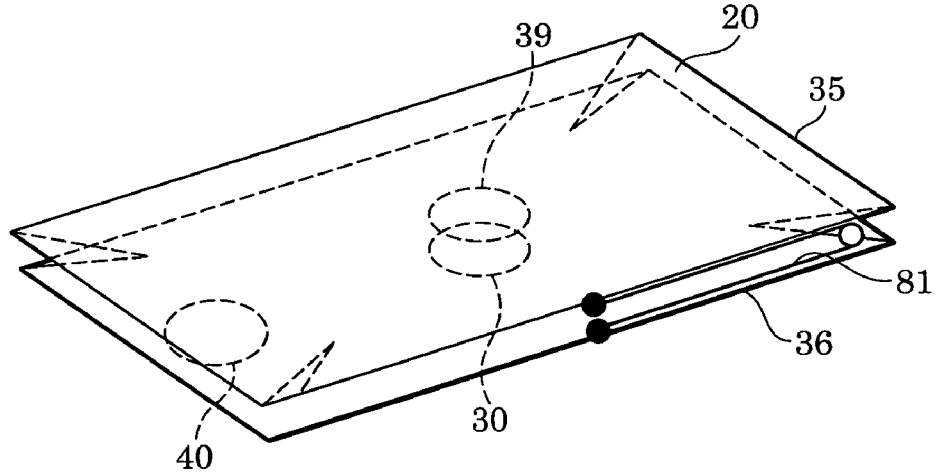
FIG. 13 is another perspective view of the sub-tank component according to the second embodiment of the present invention.

FIGS. 10 to 13 are perspective views in which electrical-wire sections are not shown. FIGS. 10 and 12 illustrate a state where one of the sub-tank components of the sub tank 20 is filled with ink, whereas FIGS. 11 and 13 illustrate a state where a certain amount of ink in the sub-tank component is consumed. FIGS. 10 and 11 illustrate an example in which a pair of compression coil springs 80 is disposed between opposite-side protrusions of the top plate 35 and opposite-side protrusions of the bottom plate 36. On the other hand, FIGS. 12 and 13 illustrate an example in which a pair of torsion coil springs 81 is provided such that two end portions of each torsion coil spring 81 are respectively fixed to a side edge of the top plate 35 and a side edge of the bottom plate 36. The two torsion coil springs 81 bias the top plate 35 in the upward direction. The compression coil springs 80 are respectively disposed at opposite sides of each sub-tank component, and similarly, the torsion coil springs 81 are respectively disposed at opposite sides of each sub-tank component. Similar to the first embodiment, the elastic coefficient of the compression coil springs 80 or the torsion coil springs 81 increases when electricity is applied thereto. Moreover, by utilizing this characteristic, these coil springs are controlled in the same manner as in the first embodiment.

Third Embodiment

Although the first and second embodiments describe a printer of a pit-stop ink-supplying type, a printer according to a third embodiment of the present invention is directed to a tube-equipped ink-supplying type in which the sub tank 20 and the main tank 22 are constantly connected to each other via a tube.

Figure 15:
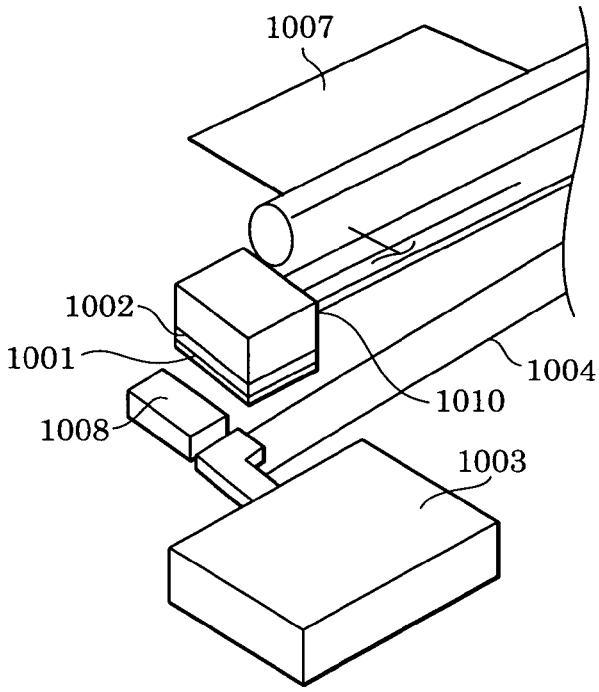
FIG. 15 is a perspective view of a printer of a tube-equipped ink-supplying type according to a third embodiment of the present invention.

Referring to FIG. 15, a carriage 1001 supports an inkjet print head 1002 and a sub tank 1010 disposed thereon. The sub tank 1010 is connected to a main tank 1003 via a tube 1004 such that ink contained in the main tank 1003 can be supplied to the sub tank 1010 via the tube 1004. Reference numeral 1007 indicates printing paper, and reference numeral 1008 indicates a capping member that seals discharge nozzles of the inkjet print head 1002 when the printer is in a power-off state or in a stand-by state so as to prevent the ink in the discharge nozzles from drying out. A section that connects the tube 1004 to the sub tank 1010 is provided with a valve, which is not shown. This valve is closed except for when ink is being supplied from the main tank 1003 to the sub tank 1010. When performing an ink-supply operation, the valve is opened and electricity is applied to each of the leaf springs 38. The structure and the positioning of the sub tank 1010, the capping member 1008, an exhaust valve, and a suction pump are the same as those in the first and second embodiments.

Furthermore, the structure, the positioning, and the operation of each leaf spring 38 are the same as those in the first embodiment.

Fourth Embodiment

In the above embodiments, each leaf spring 38 is formed of a shape-memory material, and the negative pressure is controlled by applying electricity to the leaf spring 38 to change the elastic coefficient of the leaf spring 38. According to a fourth embodiment of the present invention, the same control of the negative pressure is achieved by using a combination of a spring member composed of a metallic material, such as stainless steel, and an electromagnet.

Figure 16:
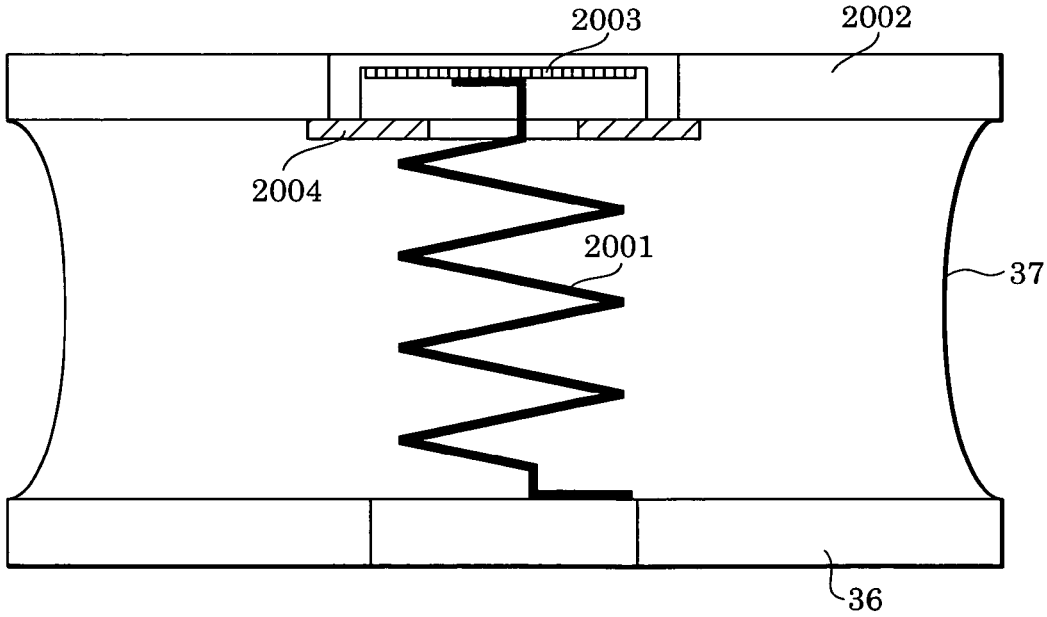
FIG. 16 is a front view of one of sub-tank components of a sub tank according a fourth embodiment of the present invention.
Figure 17:
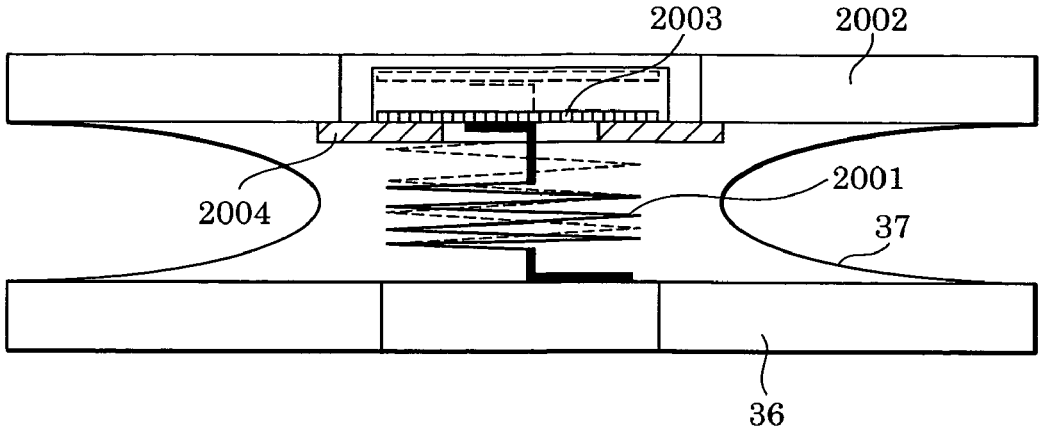
FIG. 17 is another front view of the sub-tank component according to the fourth embodiment of the present invention.
Figure 18:
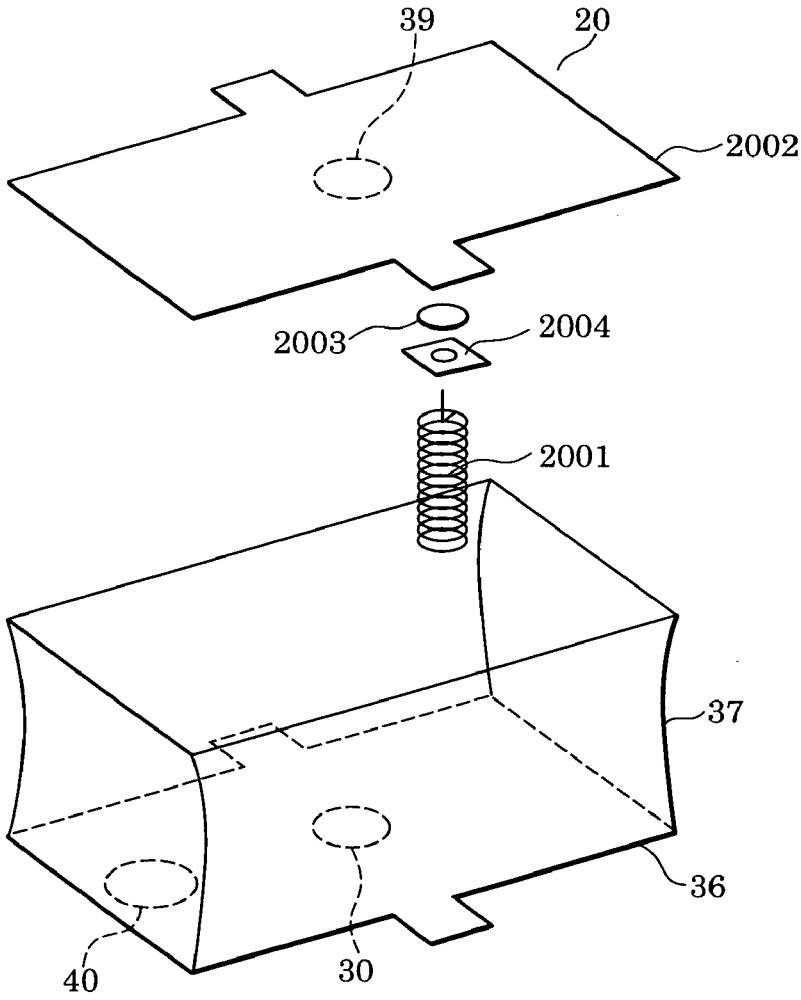
FIG. 18 is an exploded perspective view of the sub-tank component according to the fourth embodiment of the present invention.

FIGS. 16 to 18 illustrate one of sub-tank components of the sub tank 20 according to the fourth embodiment of the present invention. Specifically, FIG. 18 is an exploded perspective view that provides an easier understanding of the structure according to the fourth embodiment. Reference numeral 2001 indicates a coil spring formed of stainless steel; reference numeral 2002 indicates a top plate; reference numeral 2003 indicates a metallic movable plate attached to an end portion of the coil spring 2001 proximate the top plate 2002; and reference numeral 2004 indicates an electromagnet attached to the top plate 2002 via fixing means (not shown), such as a screw or an adhesive. A central portion of the electromagnet 2004 is provided with a hole through which the coil spring 2001 extends. The electromagnet 2004 has a wire connected thereto, which is not shown in the drawings. The elements equivalent to those in the above embodiments are indicated by the same reference numerals as used in the above embodiments, and descriptions of these elements will be omitted to prevent redundancy.

FIG. 16 illustrates a state of one of the sub-tank components of the sub tank 20 in which a sufficient amount of ink is present within the ink bag 37. Specifically, the state shown in FIG. 16 corresponds to one of a printing state, a stand-by state, and a power-off state, but does not include an ink-supplying state. Here, the elastic force of the coil spring 2001 biases the movable plate 2003 towards the top plate 2002 such that the movable plate 2003 is in contact with the top plate 2002. Accordingly, the top plate 2002 is biased upward.

FIG. 17 illustrates a state where the top plate 2002 is lowered due to ink consumption, and the coil spring 2001 is thus compressed. The dotted line in FIG. 17 indicates the position of the coil spring 2001 in one of the above-mentioned states excluding the ink-supplying state. When ink is to be supplied to one of the sub-tank components of the sub tank 20, a supply tube (not shown) is inserted into the sub-tank component so that the sub-tank component and the corresponding main-tank component become connected to each other, as in FIG. 9 according to the first embodiment. In this case, electricity is applied to the electromagnet 2004 so that the movable plate 2003 becomes attracted to the electromagnet 2004, whereby the coil spring 2001 becomes compressed, as shown with a solid line in FIG. 17. Since the coil spring 2001 is compressed while the top plate 2002 remains in its position, a force received by the top plate 2002 increases, whereby the negative pressure accordingly increases. Accordingly, the same effect is achieved as when the electricity is applied to a shape-memory material in the above embodiments. Furthermore, similar to the above embodiments, the ink is supplied to the sub-tank component of the sub tank 20 based on the pressure difference between the sub-tank component and the corresponding main-tank component of the main tank 22, whereby the top plate 2002 moves upward from the position shown in FIG. 17 towards the position shown in FIG. 16. When the top plate 2002 comes into contact with a stopper (not shown), the electricity applied to the electromagnet 2004 of the sub-tank component is turned off, and the supply tube is pulled out of the sub-tank component. Since the movable plate 2003 cannot be maintained in position when the electricity applied to the electromagnet 2004 is turned off, the movable plate 2003 becomes biased against the undersurface of the top plate 2002 by the coil spring 2001, as shown in FIG. 16. When the ink-supply operation is completed such that the top plate 2002 comes into contact with the stopper, the internal pressure of the sub-tank component is substantially equal to the atmospheric pressure. When the stopper recedes from this state, a force generated by the coil spring 2001 lifts the top plate 2002 slightly upward, whereby a balanced positional state is achieved in which a predetermined negative pressure is generated.

Accordingly, the electromagnet 2004 is electrified only during the ink-supply operation so as to control the negative pressure in the corresponding sub-tank component. Furthermore, like in the first embodiment, an ink-supply operation may be performed in a manner such that electricity is not applied to the electromagnet 2004 of a sub-tank component having little ink consumption. In this case, ink is supplied to this sub-tank component from the corresponding main-tank component using the negative pressure in the current state within a range that the time required for the ink-supply operation does not take a large amount of time.

Furthermore, in place of a shape-memory alloy, the members subject to be controlled for an elastic force, such as the movable plate, the coil spring, and the leaf spring, may alternatively be a sheet bag containing a high-polymer-containing material that is sol-gel transformable (i.e. sol state at normal temperature and gel state at higher temperature).

Moreover, such a sheet bag may alternatively be used as the ink bag 37 in the above embodiments.

As a further alternative, the sheet bag may be formed into a shape similar to that of the leaf spring 38 so that the sheet bag has a function similar to that of the leaf spring 38.

While the present invention has been described with reference to exemplary embodiments applied to an inkjet printer, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-186308 filed Jun. 24, 2004, which is hereby incorporated by reference herein.

What is claimed is:

1. A method for supplying liquid to each of first liquid-tank components of a first liquid tank from a corresponding one of second liquid-tank components of a second liquid tank via negative pressure generated by a negative-pressure generating member provided in each first liquid-tank component, the first liquid tank being movable together with a liquid discharge unit during a printing operation, each first liquid-tank component storing the liquid to be discharged during the printing operation, each second liquid-tank component storing the liquid to be supplied to the corresponding first liquid-tank component, the method comprising:

a first detecting step of detecting an amount of liquid consumption in each first liquid-tank component;

a first determining step of determining whether each first liquid-tank component needs to be supplied with the liquid based on the amount of liquid consumption detected in the first detecting step; a controlling step of controlling the magnitude of the negative pressure generated by the negative-pressure generating member with respect to each first liquid-tank component based on the amount of liquid consumption detected in the first detecting step, wherein the magnitude of the negative pressure generated during a liquid-supply operation is greater than that in a state other than the liquid-supply operation;

a second detecting step of detecting an orientation of one of the first liquid tank, the second liquid tank, and a printing device provided with the first liquid tank and the second liquid tank; and a second determining step of determining whether the orientation detected in the second detecting step is within a predetermined range, wherein the liquid is supplied to the first liquid tank from the second liquid tank when it is determined in the second determining step that the orientation detected in the second detecting step is within the predetermined range.

2. The method according to claim 1, further comprising a setting step of setting an amount of negative pressure generated by the negative-pressure generating member when the liquid is supplied to each first liquid-tank component from the corresponding second liquid-tank component within a range such that liquid in discharge nozzles provided in the liquid discharge unit is prevented from flowing in a direction opposite to a discharging direction of the liquid discharge unit.

3. The method according to claim 1, wherein the controlling step includes individually controlling any increase in the magnitude of the negative pressure generated by the negative-pressure generating member for each of the first liquid-tank components depending on the amount of liquid consumption detected in the first detecting step.

4. The method according to claim 1, wherein the negative-pressure generating member is formed of a shape-memory material, and wherein the controlling step includes applying electricity to the negative-pressure generating member with respect to each first liquid-tank component when the liquid-supply operation is to be performed.

5. The method according to claim 4, wherein the applying step includes applying an amount of electricity to the negative-pressure generating member with respect to each first liquid-tank component depending on the amount of liquid consumption detected in the first detecting step.

6. The method according to claim 1, wherein the negative-pressure generating member is formed of a shape-memory material, and wherein the controlling step includes heating the negative-pressure generating member in each first liquid-tank component when the liquid-supply operation is to be performed.

7. A method for supplying liquid to a first liquid tank from a second liquid tank by using negative pressure generated by a negative-pressure generating member provided in the first liquid tank, the first liquid tank being movable together with a liquid discharge unit during a printing operation and storing the liquid to be discharged during the printing operation, the second liquid tank storing the liquid to be supplied to the first liquid tank, the method comprising the steps of:

controlling a magnitude of negative pressure generated by the negative-pressure generating member such that the magnitude of the negative pressure generated during a liquid-supply operation is greater than that in a state other than the liquid-supply operation; and detecting an orientation of one of the first liquid tank, the second liquid tank, and a printing device provided with the first liquid tank and the second liquid tank, wherein the liquid is supplied to the first liquid tank from the second liquid tank responsive to detecting the orientation to be within a predetermined range.

8. The method according to claim 7, further comprising the steps of:

detecting an amount of liquid consumption in each of first liquid-tank components included in the first liquid tank;

determining whether each first liquid-tank component needs to be supplied with the liquid based on the amount of liquid consumption detected; and controlling the magnitude of the negative pressure generated by the negative-pressure generating member provided for each first liquid-tank component based on the amount of liquid consumption detected.

9. The method according to claim 7, further comprising the step of setting an amount of negative pressure generated by the negative-pressure generating member when the liquid is supplied to the first liquid tank from the second liquid tank within a range such that liquid in discharge nozzles provided in the liquid discharge unit is prevented from flowing in a direction opposite to a discharging direction of the liquid discharge unit.

10. The method according to claim 7, wherein the controlling step includes individually controlling any increase in the magnitude of the negative pressure generated by the negative-pressure generating member provided for each first liquid-tank component depending on an amount of liquid consumption of each of the first liquid-tank components.

11. The method according to claim 7, wherein the negative-pressure generating member is formed of a shape-memory material, and wherein the controlling step includes applying electricity to the negative-pressure generating member when the liquid-supply operation is to be performed.

12. The method according to claim 11, wherein the applying step includes applying an amount of electricity to the negative-pressure generating member provided for each of first liquid-tank components included in the first liquid tank depending on an amount of liquid consumption of the first liquid-tank component.

13. The method according to claim 7, wherein the negative-pressure generating member is formed of a shape-memory material, and wherein the controlling step includes heating the negative-pressure generating member when the liquid-supply operation is to be performed.

* * * * *